US011095053B1

(12) United States Patent
Wu

(10) Patent No.: US 11,095,053 B1
(45) Date of Patent: Aug. 17, 2021

(54) TOOL-LESS TERMINAL BLOCK

(71) Applicants: DINKLE ENTERPRISE CO., LTD., New Taipei (TW); DINKLE ELECTRIC MACHINERY (CHINA) CO., LTD., Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Jiangsu (CN)

( * ) Notice: Subject to any disclaimer, the term of this patent is extended or adjusted under 35 U.S.C. 154(b) by 0 days.

(21) Appl. No.: 16/898,400

(22) Filed: Jun. 10, 2020

(51) Int. Cl.
*H01R 4/48* (2006.01)
*H01R 9/24* (2006.01)

(52) U.S. Cl.
CPC ..... *H01R 4/4836* (2013.01); *H01R 9/2416* (2013.01)

(58) Field of Classification Search
CPC .... H01R 4/489; H01R 4/4836; H01R 4/4827; H01R 4/4818; H01R 4/4845; H01R 4/5008; H01R 9/26; H01R 9/2416; H01R 9/223; H01R 13/627; H01R 13/62977
USPC ..... 439/495, 438, 441
See application file for complete search history.

(56) References Cited

U.S. PATENT DOCUMENTS

| | | | | |
|---|---|---|---|---|
| 10,103,460 | B2 * | 10/2018 | Ono | H01R 11/07 |
| 10,230,179 | B2 * | 3/2019 | Wilinski | H01R 9/2416 |
| 2014/0370740 | A1 * | 12/2014 | Kollmann | H01R 13/627 439/438 |

* cited by examiner

*Primary Examiner* — William H. Mayo, III
(74) *Attorney, Agent, or Firm* — Chun-Ming Shih; HDLS IPR Services

(57) ABSTRACT

A tool-less terminal block includes an insulated base, a turning part, a conductive terminal and a spring clamp. The insulated base has a cavity and a slot communicating to the cavity; the turning part is pivotally coupled to the insulated base; the conductive terminal is fixed to the bottom of the slot; the spring clamp is accommodated in the cavity and disposed at the top of the conductive terminal, and the spring clamp has a movable elastic arm pressing the conductive terminal to seal the slot, and the movable elastic arm has a link rod fixed to the turning part and operable together with the turning part. When the turning part is turned to a released position, the link rod is pulled by the turning part to drive the movable elastic arm away from the conductive terminal to open the slot, so as to provide a convenient use.

5 Claims, 8 Drawing Sheets

TOOL-LESS TERMINAL BLOCK

BACKGROUND OF THE INVENTION

1. Technical Field

The technical field of this disclosure relates to a terminal block structure, and more particularly to a tool-less terminal block.

2. Description of Related Art

Terminal block is an electrical connection device, which has already been used extensively in machinery and equipment (such as industrial computers, uninterruptible power systems, power supply devices, etc.), industrial control equipment (such as electromechanical systems, refrigeration & air conditioning, programmable controllers, etc.), and electric appliances (such as air-conditioner, refrigerators, washing machines, ovens, etc.) for connecting a plurality of electrical wires.

In general, a conventional terminal block is formed by combining an insulated base and a conductive terminal, and the insulated base further has an elastic plate installed therein for fixing a wire, wherein a screwdriver or another tool is used to press the elastic plate, and then the wire is inserted into the insulated base and connected and conducted to the conductive terminal, and finally the screwdriver or tool is withdrawn to allow the elastic plate to press and fix the wire in the insulated base.

In the aforementioned wiring operation of the terminal block, the screwdriver or tool is not designed specifically for the wiring purpose, so that the operation by using the screwdriver or tool for wiring the terminal block is inconvenient, and the screwdriver or tool may damage the terminal block accidentally. Therefore, it is an important subject for related manufacturers to develop a terminal block with a convenient wiring operation.

In view of the aforementioned drawbacks of the prior art, the discloser of this disclosure based on years of experience in the related industry to conduct extensive research and experiment, and finally provided a feasible solution to overcome the drawbacks of the prior art.

SUMMARY OF THE INVENTION

Therefore, it is a primary object of this disclosure to provide a tool-less terminal block capable of driving a movable elastic arm away from a conductive terminal to open a slot by turning a turning part, so as to save the use of a screwdriver or another tool and provide a convenient use of the terminal block.

To achieve the aforementioned and other objectives, this disclosure discloses a tool-less terminal block, comprising: an insulated base, having a cavity formed therein and a slot formed on the insulated base and communicating to the cavity; a turning part, pivotally coupled to the insulated base; a conductive terminal, fixed to the bottom of the slot; and a spring clamp, accommodated in the cavity and disposed at the top of the conductive terminal, and having a movable elastic arm pressing on the conductive terminal to seal the slot and a link rod extending from the movable elastic arm and fixed to the turning part and operable together with the turning part; wherein, when the turning part is rotated to a released position, the link rod is pulled by the turning part to drive the movable elastic arm away from the conductive terminal and open the slot.

Compared with the conventional terminal block that uses a screwdriver or any other tool to press the elastic plate, this disclosure rotates the turning part to drive the movable elastic arm to open the slot or press the core wire of the wire for electrically connecting the conductive terminal, so as to save the use of a screwdriver or tool and improve the convenience of use of the tool-less terminal block.

DESCRIPTION OF THE PREFERRED EMBODIMENTS

Figure 1:
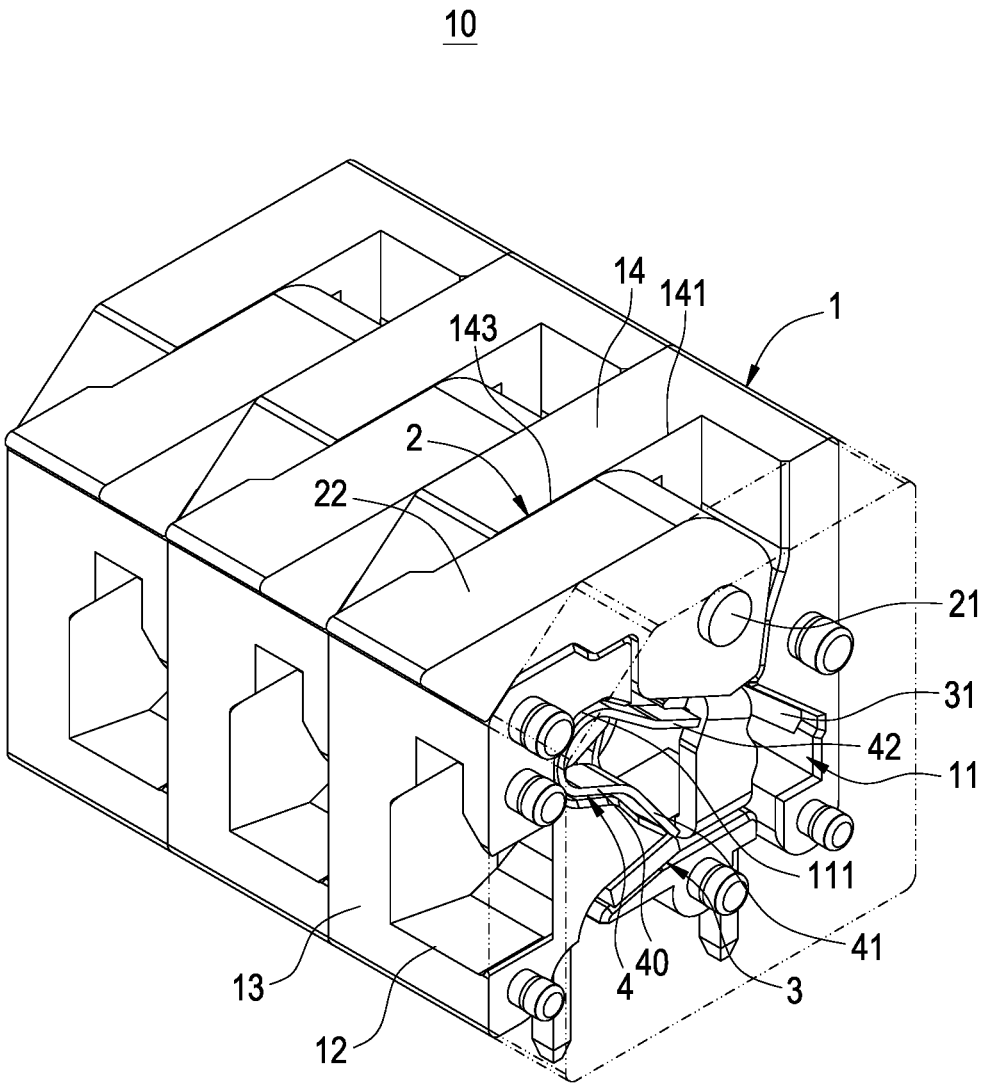
FIG. 1 is a perspective view of a tool-less terminal block of this disclosure.
Figure 2:
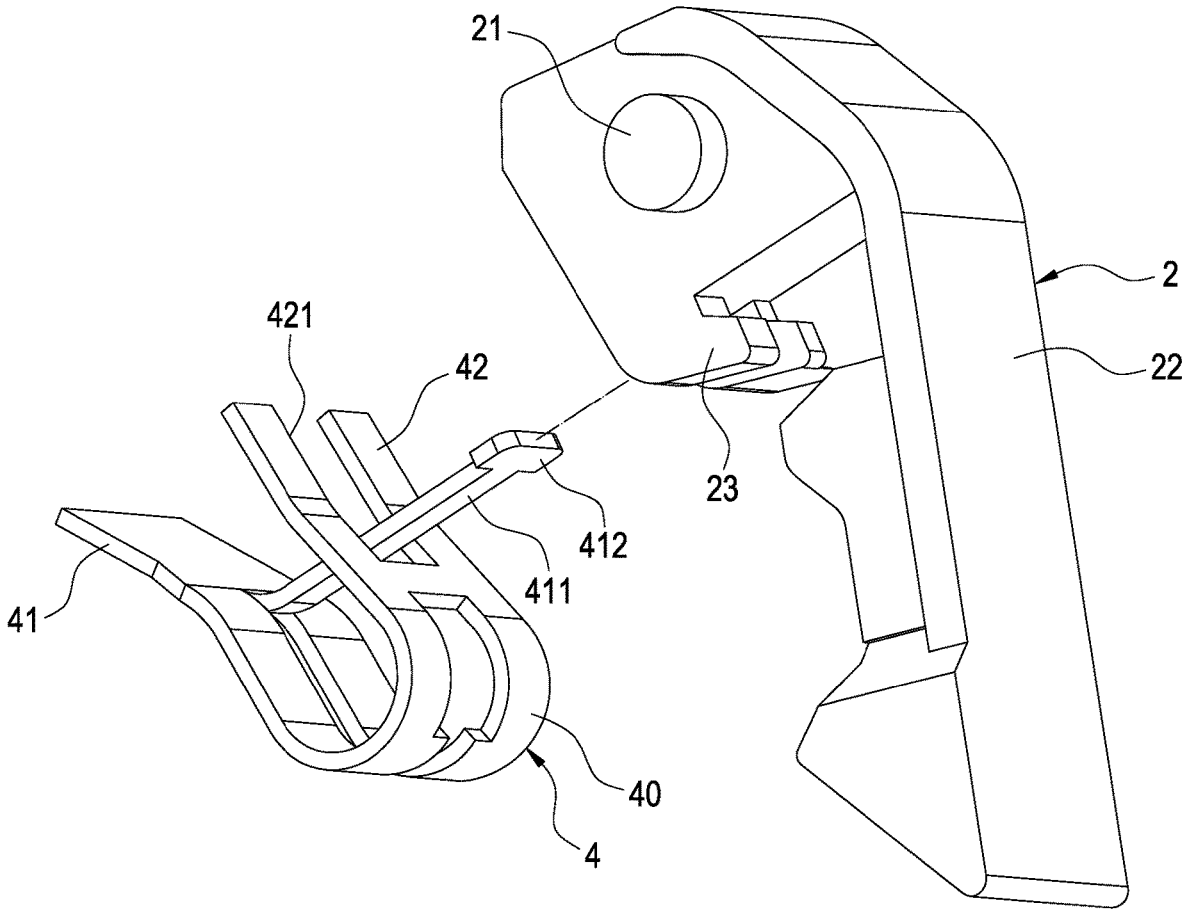
FIG. 2 is an exploded view of this disclosure.
Figure 3:
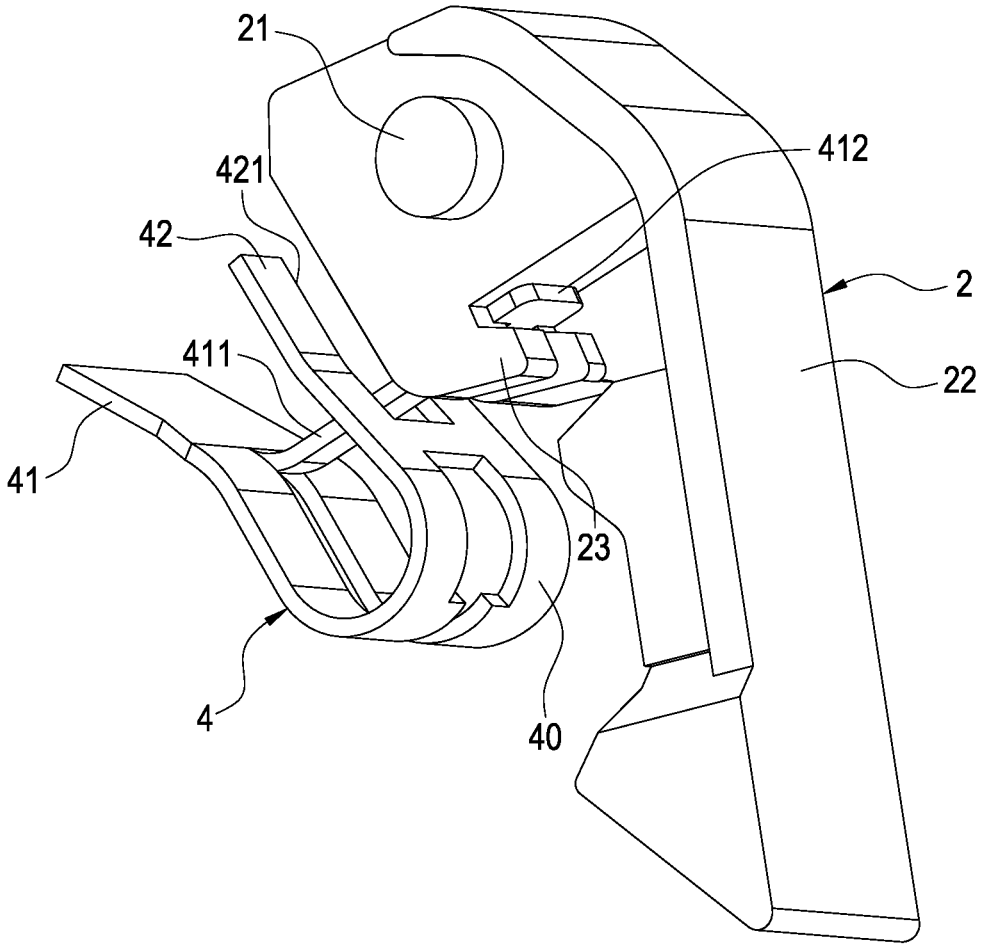
FIG. 3 is a perspective view of this disclosure.
Figure 4:
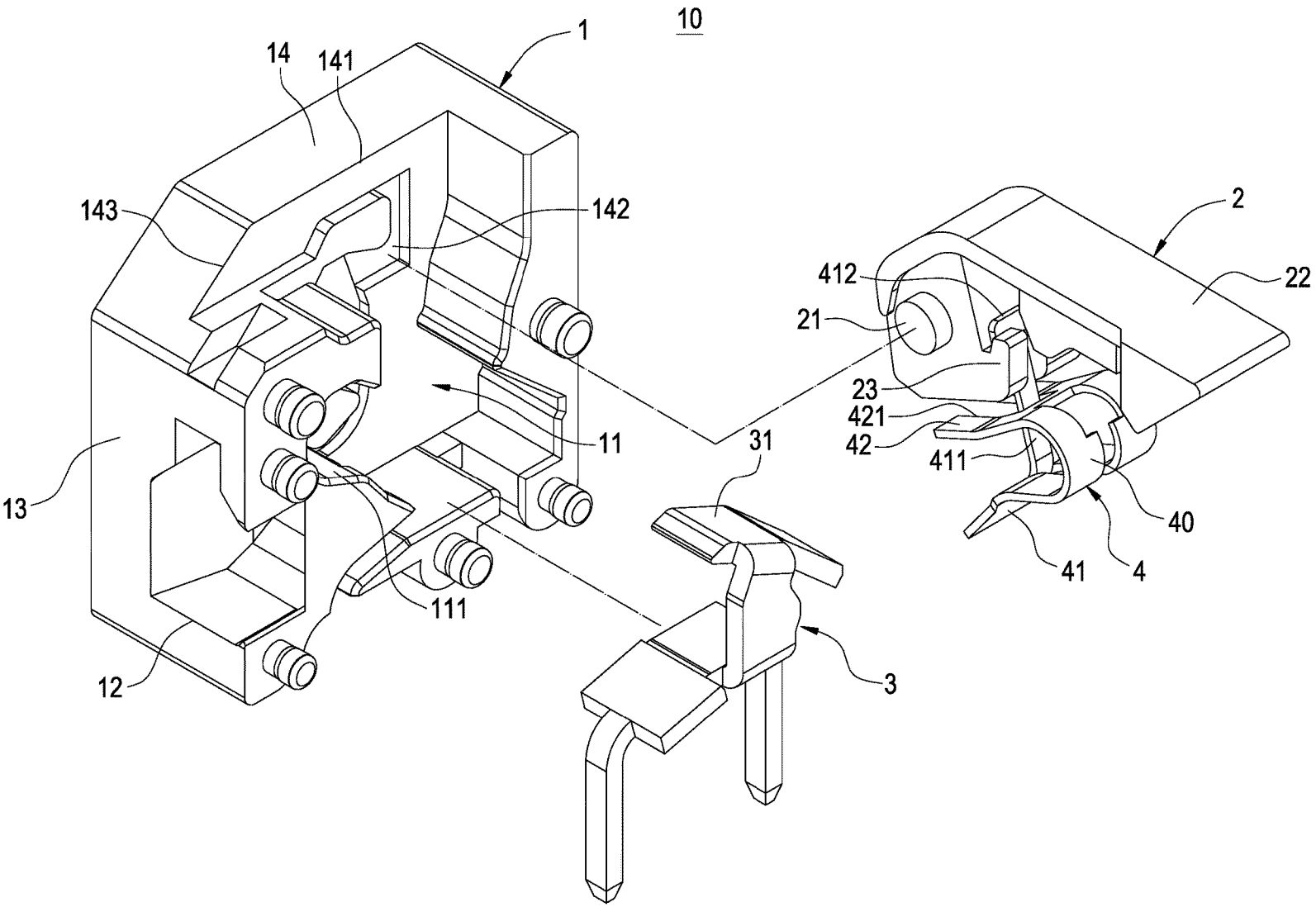
FIG. 4 is an exploded view of a tool-less terminal block of this disclosure.

The technical contents of this disclosure will become apparent with the detailed description of preferred embodiments accompanied with the illustration of related drawings as follows. It is intended that the embodiments and drawings disclosed herein are to be considered illustrative rather than restrictive.

With reference to FIGS. 1 to 8 for a tool-less terminal block of this disclosure, the tool-less terminal block 10 comprises an insulated base 1, a turning part 2, a conductive terminal 3 and a spring clamp 4.

In FIGS. 1, and 4 to 8, the insulated base 1 has a cavity 11 therein and a slot 12 formed thereon and communicating to the cavity 11, and a U-shaped groove 111 is formed on an inner wall of the cavity 11.

Specifically, the insulated base 1 has a front sidewall 13 and a top wall 14, and the slot 12 is formed on the front sidewall 13, and a through slot 141 is formed on the top wall 14 and communicates to the cavity 11, and two pivot holes 142 are formed on an inner wall of the through slot 141, and the top wall 14 further has a notch 143 formed between the front sidewall 13 and the two pivot holes 142.

In FIGS. 1 to 8, the turning part 2 is pivotally coupled to the insulated base 1 and rotated between a locked position and a released position, and the turning part 2 is accommodated in the through slot 141 and has two pivots 21 pivotally coupled to the two pivot holes 142, and the turning part 2 further has two L-shaped hook blocks 23 accommodated in the through slot 141 and disposed between the front sidewall 13 and the two pivot holes 142.

Further, the turning part 2 has a handle 22 that can be stored in the notch 143, and the locked position refers to the position when the handle 22 is stored in the notch 143, and the released position refers to the position when the handle 22 is protruded from the notch 143.

In FIGS. 1, and 4 to 8, the conductive terminal 3 is fixed to the bottom of the slot 12, and conductive terminal 3 has a stopper plate 31 extending upwardly, and the stopper plate 31 is disposed between the turning part 2 and the spring clamp 4, and the turning part 2 is stopped and positioned by the stopper plate 31.

In FIGS. 1 to 8, the spring clamp 4 is accommodated in the cavity 11 and disposed at the top of the conductive terminal 3, wherein the spring clamp 4 is a U-shaped spring plate 40 having a movable elastic arm 41 at an end and an elastic positioning wall 42 at the other end, and the movable elastic arm 41 presses at the conductive terminal 3 and seals the slot 12, and the movable elastic arm 41 further has a link rod 411 extending therefrom, and an end of the link rod 411 has a T-shaped bump 412 engaged with two L-shaped hook blocks 23 to fix the link rod 411 to the turning part 2 and is operable together with the turning part 2.

In addition, the middle of the U-shaped spring plate 40 is embedded into the U-shaped groove 111, and the elastic positioning wall 42 is blocked and positioned by the stopper plate 31, so that the middle of the U-shaped spring plate 40 and the elastic positioning wall 42 are fixed into the cavity 11 stably.

In addition, an end of the elastic positioning wall 42 has a long groove 421, and the link rod 411 is passed into the long groove 421, wherein the link rod 411 is formed by cutting the U-shaped spring plate 40 and folding the cut U-shaped spring plate 40 reversely towards the outside, so as to achieve the effects of improving the utility of materials and saving costs.

Figure 5:
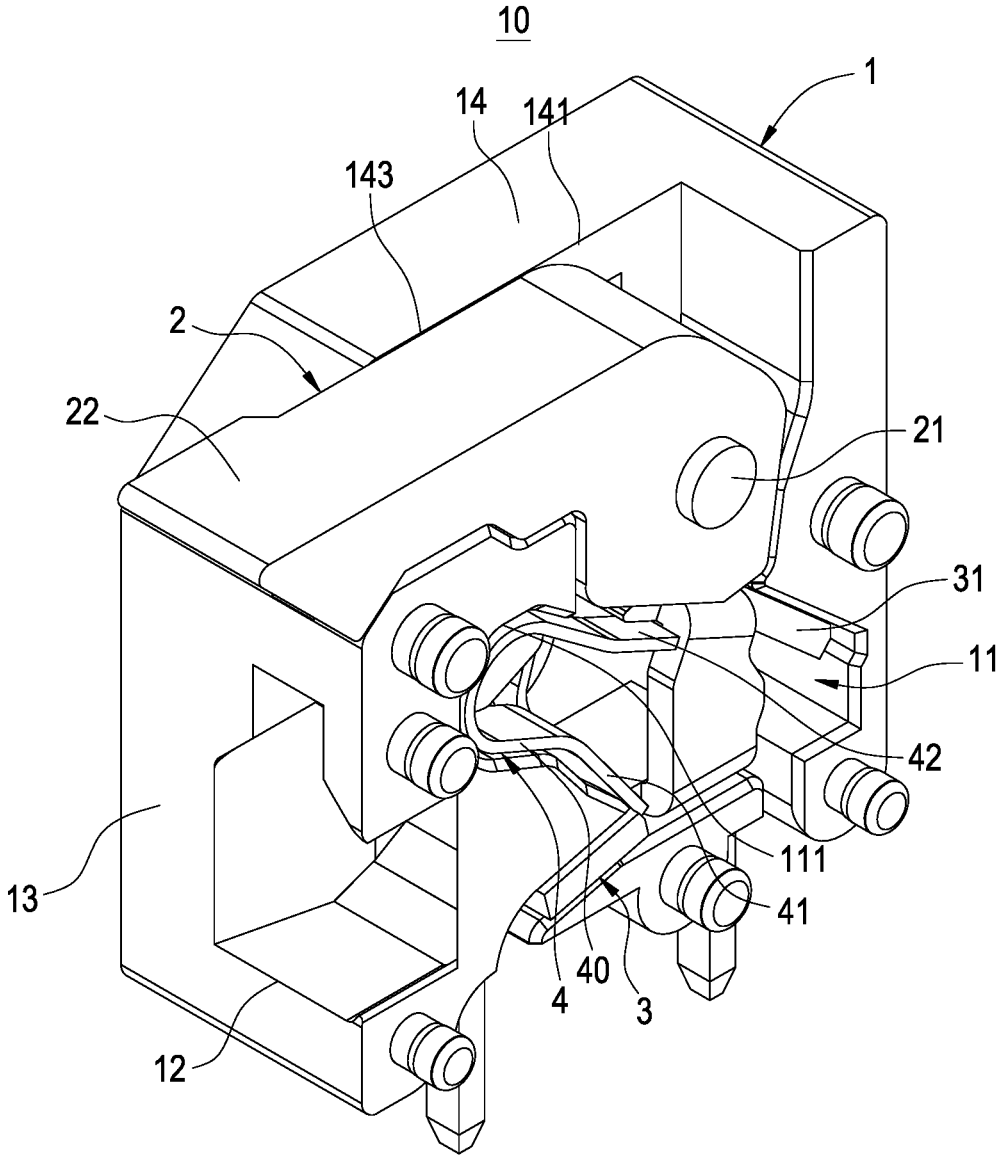
FIG. 5 is a perspective view of a tool-less terminal block of this disclosure.
Figure 6:
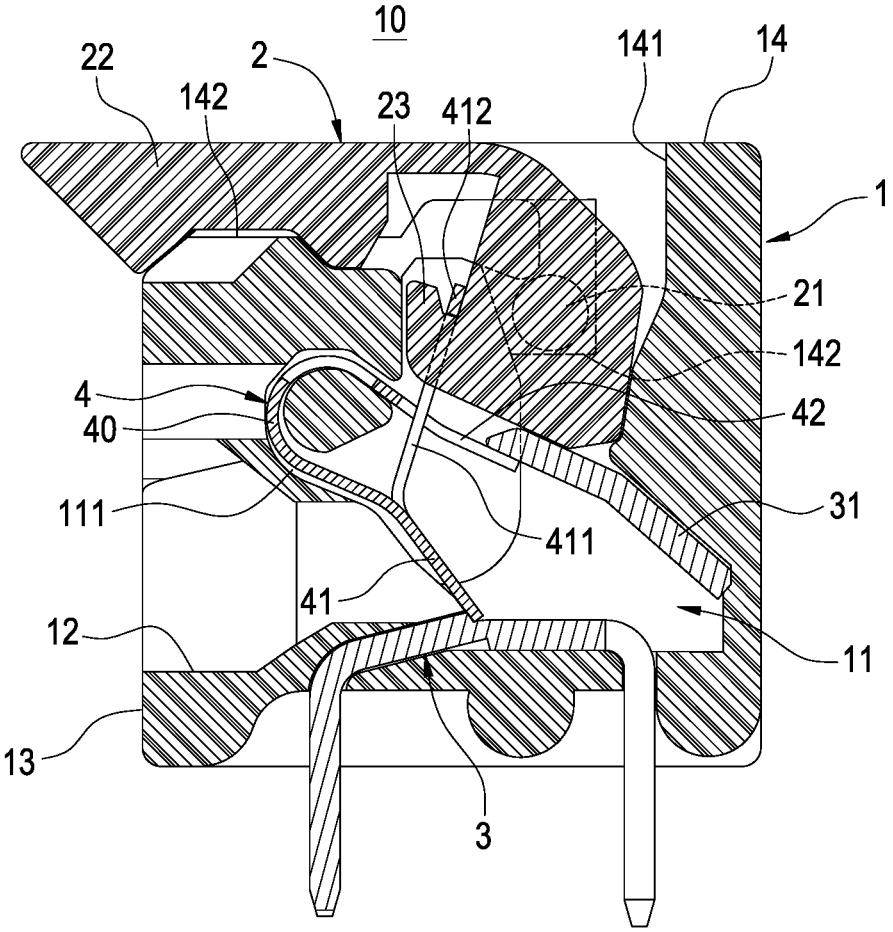
FIG. 6 is a cross-sectional view of a tool-less terminal block of this disclosure.
Figure 7:
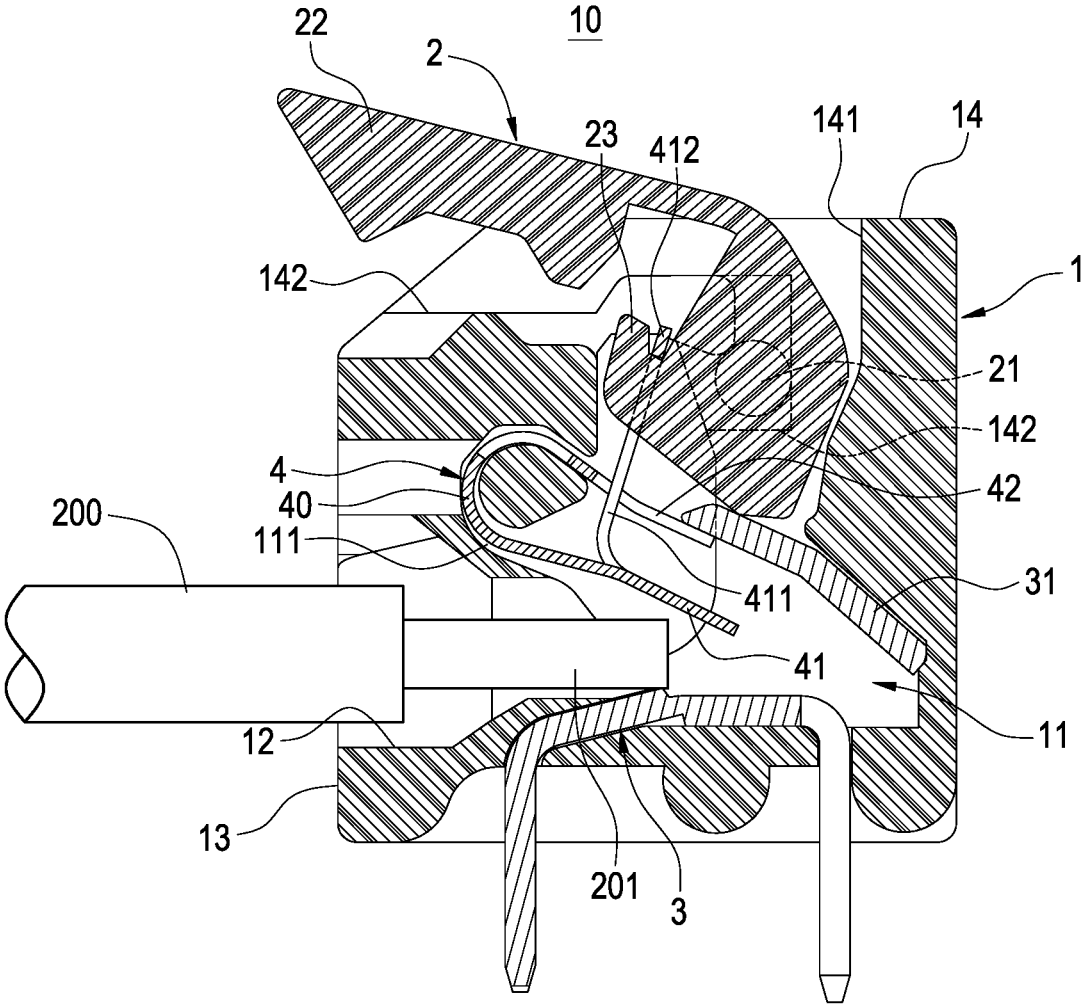
FIG. 7 is a schematic view of a using status of a tool-less terminal block of this disclosure.
Figure 8:
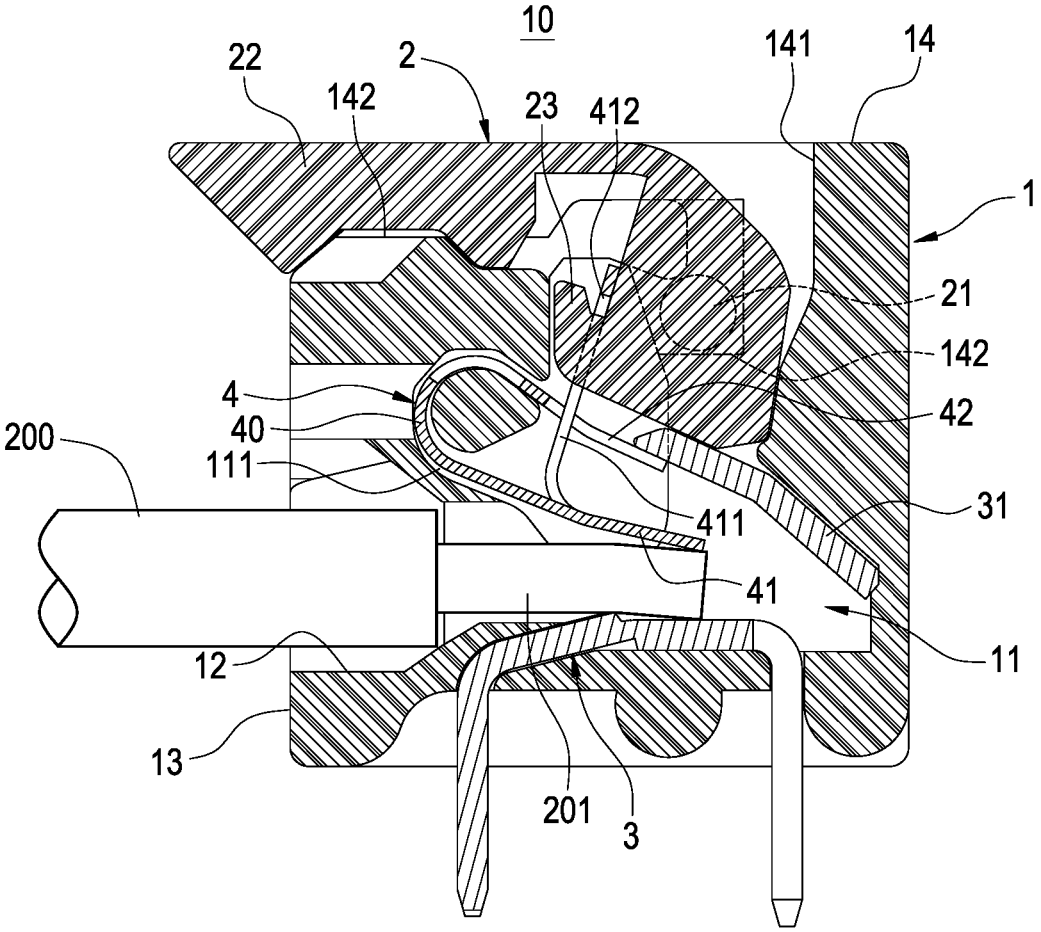
FIG. 8 is a schematic view of another using status of a tool-less terminal block of this disclosure.

With reference to FIGS. 5 to 8 for the using status of a tool-less terminal block 10 of this disclosure, FIGS. 5 and 6 show that when the turning part 2 is rotated to a locked position (at which the handle 22 is hidden into the notch 143), the link rod 411 has not been pulled by the turning part 2 to restore its original position, the movable elastic arm 41 presses at the conductive terminal 3 and seals the slot 12. In FIG. 7, when it is necessary to install the wire 200 to the slot 12, the turning part 2 is rotated to a released position (at which the handle 22 is protruded from the notch 143), the two L-shaped hook blocks 23 moved upwardly with the turning part 2, while the two L-shaped hook blocks 23 pull the T-shaped bump 412 upward, so that the link rod 411 is pulled by the turning part 2 to drive the movable elastic arm 41 to move upwardly away from the conductive terminal 3 and open the slot 12, and the wire 200 can be inserted into the slot 12. In FIG. 8, the turning part 2 is rotated to the locked position (at which the handle 22 is hidden into the notch 143), and the movable elastic arm 41 is moved to resume its original position near the conductive terminal 3 until the movable elastic arm 41 presses a core wire 201 of the wire 200 and touches the conductive terminal 3. In other words, the movable elastic arm 41 and the conductive terminal 3 jointly clamp the core wire 201 of the wire 200, so that the wire 200 and the conductive terminal 3 are electrically coupled to each other.

Compared with the prior art that uses a screwdriver or another tool to press the elastic plate, this disclosure turns the turning part 2 to drive the movable elastic arm 41 to open the slot 12 or press the core wire 201 of the wire 200 to electrically connect the conductive terminal 3, so as to achieve the effects of skipping the use of screwdrivers or other tools, meeting the quick release requirement of the wire 200, and improving customers' efficiency.

In this disclosure, a plurality of tool-less terminal blocks 10 can be combined with each other and a plurality of insulated bases 1 can be combined together by concave and convex structures to provide a plurality of slots 12 and a plurality of conductive terminals 3 for connecting a plurality of wires 200.

While this disclosure has been described by means of specific embodiments, numerous modifications and variations could be made thereto by those skilled in the art without departing from the scope and spirit of this disclosure set forth in the claims.

What is claimed is:

1. A tool-less terminal block, comprising:

an insulated base, having a cavity formed therein and a slot formed on the insulated base and communicating to the cavity;

a turning part, pivotally coupled to the insulated base;

a conductive terminal, fixed to the bottom of the slot; and a spring clamp, accommodated in the cavity and disposed at the top of the conductive terminal, and having a movable elastic arm pressing on the conductive terminal to seal the slot and a link rod extending from the movable elastic arm and fixed to the turning part and operable together with the turning part;

wherein, when the turning part is rotated to a released position, the link rod is pulled by the turning part to drive the movable elastic arm away from the conductive terminal and open the slot, wherein the turning part is rotated between a locked position and the released position, and when the turning part is rotated to the locked position, the link rod is not pulled by the turning part, so that the movable elastic arm presses on the conductive terminal and seals the slot and resumes its original position, wherein the spring clamp is a U-shaped spring plate having the movable elastic arm at an end of the U-shaped spring plate and an elastic positioning wall formed at the other end of the U-shaped spring plate, wherein the cavity has a U-shaped groove formed on an inner wall thereof, and the conductive terminal has a stopper plate extending upwardly, and the middle of the U-shaped spring plate is embedded into the U-shaped groove, and the elastic positioning wall is blocked and positioned by the stopper plate, wherein the stopper plate is disposed between the turning part and the spring clamp, and the turning part is blocked and positioned by the stopper plate, and wherein the elastic positioning wall has a long groove formed at an end thereof, and the link rod is passed into the long groove.

2. The tool-less terminal block as claimed in claim 1, wherein the insulated base has a front sidewall and a top wall, and the top wall has a through slot communicating to the cavity, and the through slot has two pivot holes extending from an inner wall thereof, and the turning part is accommodated in the through slot and has two pivots pivotally coupled to the two pivot holes respectively, and the slot is formed on the front sidewall.

3. The tool-less terminal block as claimed in claim 2, wherein the top wall has a notch formed between the front sidewall and the two pivot holes, and the turning part has a handle that can be stored in the notch, and the locked position refers to a position when the handle is stored in the notch.

4. The tool-less terminal block as claimed in claim 3, wherein the turning part has two L-shaped hook blocks accommodated in the through slot and disposed between the front sidewall and the two pivot holes, and a T-shaped bump is extended from an end of the link rod and engaged with the two L-shaped hook blocks.

5. The tool-less terminal block as claimed in claim 1, wherein the link rod is formed by cutting the U-shaped spring plate and then reversely folding the cut U-shaped spring plate to the outside.

* * * * *